United States Patent [19]

Hickle

[11] 3,965,546

[45] June 29, 1976

[54] PLASTIC FILM CONNECTOR FOR INFLATABLE STRUCTURES

[75] Inventor: Jerry J. Hickle, Findlay, Ohio

[73] Assignee: R. L. Kuss & Co., Inc., Findlay, Ohio

[22] Filed: Aug. 7, 1975

[21] Appl. No.: 602,883

[52] U.S. Cl. ..... 24/243 K; 52/2

[51] Int. Cl.[2] ..... A44B 21/00; E04B 1/34

[58] Field of Search ..... 52/2; 24/243 K; 160/392, 368 R; 16/172; 24/72.5

[56] References Cited

UNITED STATES PATENTS

| | | | |
|---|---|---|---|
| 3,182,769 | 5/1965 | De Ridder | 24/243 K |
| 3,803,671 | 4/1974 | Stuppy et al. | 24/243 K |
| 3,805,873 | 4/1974 | Bloomfield | 160/392 |

FOREIGN PATENTS OR APPLICATIONS

| | | | |
|---|---|---|---|
| 1,132,469 | 11/1968 | United Kingdom | 24/243 K |

*Primary Examiner*—Donald A. Griffin
*Attorney, Agent, or Firm*—Vincent L. Barker, Jr.

[57] ABSTRACT

A device for releasably retaining together in air-tight relationship the edges of a plurality of film layers which may be used, for example, in an inflatable structure. The device includes a pair of elongate strips, one of which is snapped into the other with the edges of the film layers positioned therebetween, thereby forming a seam at the film edges. The strips are preferably extruded shapes which are coextensive in length with the edges of the film to be sealed together. Means are provided for anchoring the strips to the ground after they have been engaged with the film layer edges, with the anchor means designed to enhance the locking force placed on the device.

5 Claims, 6 Drawing Figures

PLASTIC FILM CONNECTOR FOR INFLATABLE STRUCTURES

BACKGROUND OF THE INVENTION

The invention relates to fastening means for flexible panels, and more particularly to a releasable fastening and holding means for the edges of flexible film layers which form a part of an inflated structure.

Various connecting devices and fasteners for flexible panels and sheets have been suggested.

Commonly-owned U.S. Pat. No. 3,464,480 shows a multiple-component fastener for suspending a flexible panel or sheet in vertical position. This device requires the sheet to have a hem through which a bar is placed which is then locked between two other components of the fastener. In this type of device, the direction of the pull on the sheet will not vary and it is not intended to seal two or more sheet edges together.

U.S. Pat. No. 3,805,873 shows a two-component elongate fastener including a channel having opposed concave sides for receiving a flat locking member. The flexible panel is wrapped around the locking member and as such may be inserted into a deeper of the two concave ends and freely slipped into the other concave end. When tension is put on the flexible panel, the locking member is held within the channel.

U.S. Pat. No. 3,273,497 shows another elongate strip type fastening device for a flexible panel. The patent shows the edge of a screen panel fastened to a frame by means of a two-piece fastening device including a flat bar member which sandwiches the screen into a receiving member, one end of which is concave for holding down one edge of the flat bar. The bar has a slot at one location on its edge opposite the concavity of the receiving member, and in a corresponding location on the receiving member is a protrusion over which the slot in the bar can pass. When the screen and locking bar have been inserted into the receiving member and are passed under the protrusion, the bar may be slid longitudinally to displace the slot from the protrusion, thereby locking the bar and the screen in position. The bar does not snap into the receiving member in an interference fit, nor is the bar tightly held within the receiving member.

Particularly in air inflatable structures consisting of panels of flexible plastic film, there is a need for an inexpensive, reliable and easily assembled fastener which will form an air-tight seal and also provide a means for holding the edge of the air inflatable structure to the ground or to another structure. See, for example, the co-pending allowed patent application of Frank E. Rom Ser. No. 450,424, filed Mar. 12, 1974, now U.S. Pat. No. 3,908,631, showing an air conduit including a plurality of layers which must be bound together in an elongate air-tight seam and also anchored to the ground for proper operation of the apparatus. The present invention described below is adaptable for use with such structures, as well as other air inflated structures requiring a reliable air-tight seam.

SUMMARY OF THE INVENTION

The present invention is a holding means, an edge connector and seam forming device for flexible films, relatively simple in structure and easily assembled to form an air-tight seam at the edges of plastic film layers. The fastening apparatus is advantageously used to hold in location and form the edge seals of air inflated structures. The invention eliminates the need for preformed perimeter seals on air structures, simplifying the overall manufacture and assembly operation and thus reducing construction and repair costs.

The apparatus consists of a pair of interfitting elongate extrusions, preferably of a relatively rigid plastic material but in any event of a slightly yieldable material. A locking extrusion is snapped into a base extrusion with the multiple film layers sandwiched therebetween. By the shape and relative sizing of the two extrusions, described in detail below, an air-tight film seal results. Attachment means are provided for fixing the apparatus and the seam formed thereby to the ground or other fixed structure.

DESCRIPTION OF THE PREFERRED EMBODIMENT

Figure 1:
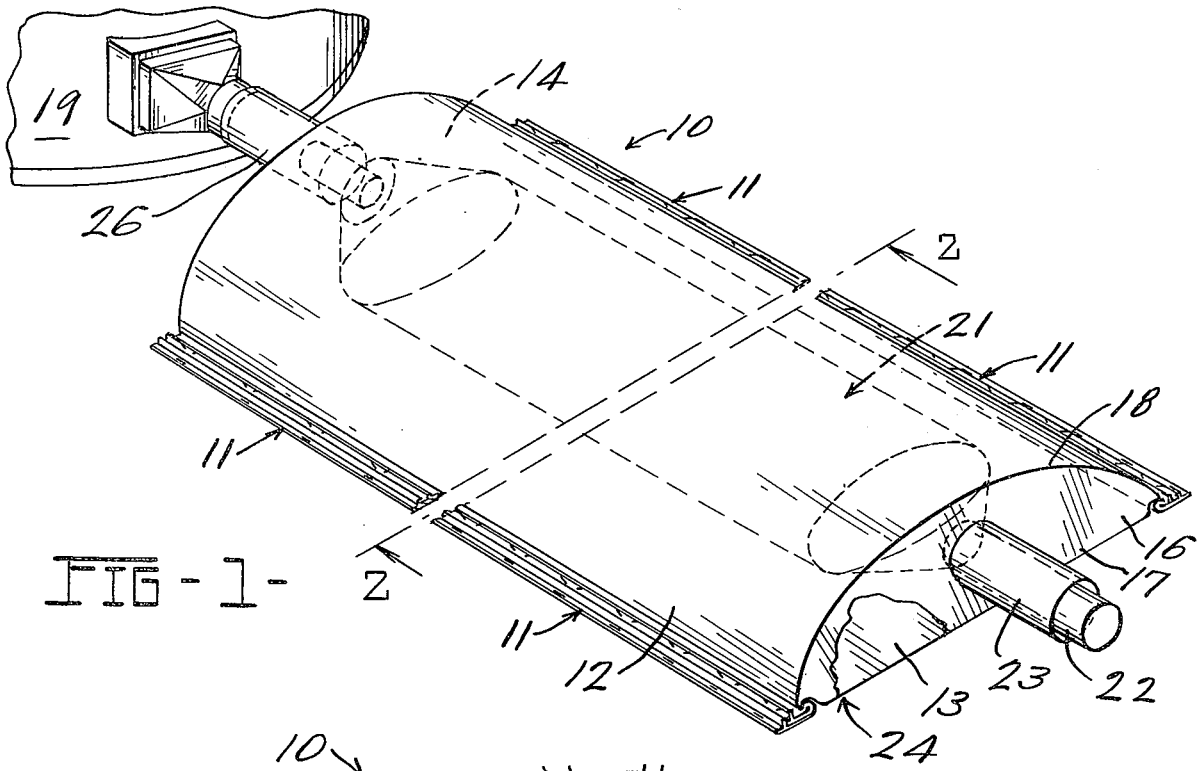
FIG. 1 is a perspective view showing an air inflated structure employing the film connector of the invention.

FIG. 1 of the drawings shows an inflated structure 10 employing a film connector 11 according to the invention to hold the structure 10 in position on the ground and to retain layers of plastic film 12 and 13 together in air-tight relationship. In the solar heat collector device which is used to illustrate the film connector of this invention, the film layer 12 is a transparent cover for the structure 10 while the layer 13 serves as a floor and is preferably of a dark, heat absorbent color. End panels 14 and 16, preferably folded from the bottom panel along a lower line 17 and sealed with the top transparent sheet along an upper arc 18, form air-tight ends on the structure 10.

The apparatus 10 further includes an inner conduit 21 of a dark, opaque film material, connected through an inner duct 22 with a blower (not shown). An outer duct 23, also connected to an air blower (not shown), communicates with the space defined interior of the film layers 12 and 13 and end panels 14 and 16, exterior of the inner conduit 21. Both the inner conduit 21 and the outer encasing conduit, which may be generally identified as 24, are thereby inflated while air travels through them toward the grain storage facility 19. At the downstream end of the structure 10, heated air from the inner conduit 21 and air from the outer encasing conduit 24, which is heated to a somewhat lesser extent, are emptied into a common effluent duct 26 which connects with the grain storage facility 19.

Figure 2:
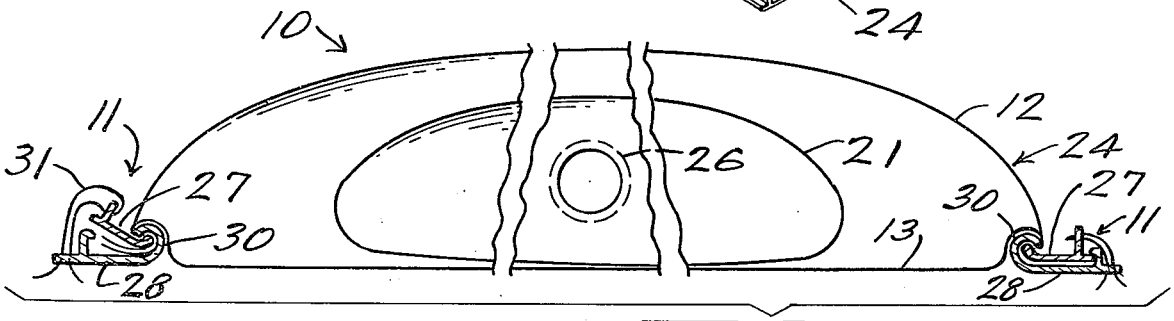
FIG. 2 is an elevational sectional view taken along the line 2—2 of FIG. 1.

FIG. 2 shows the plastic film connectors 11 of the invention, indicating their manner of engagement with the plastic film layers 12 and 13 of the outer encasing conduit 24. The film connectors 11 comprise an inner locking component 27 and a base or outer component 28. As shown in FIG. 2, the connector is assembled by slipping a toe portion 29 of the locking component 27 into a rolled end 30 of the base component 28 with the film layers lying therebetween, and then snapping the inner component 27 down into the outer component 28. A hold-down line 31, which runs along the ground adjacent to the assembled film connector 11, is passed through the lower component 28 and connected with the upper component 27, as seen more clearly in reference to FIGS. 3, 4 and 5.

Figure 3:
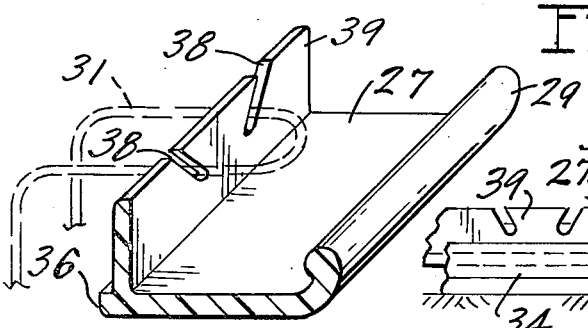
FIG. 3 is a perspective view showing the inner component of the film connector and the way in which it is connected to a tie-down line.
Figure 6:
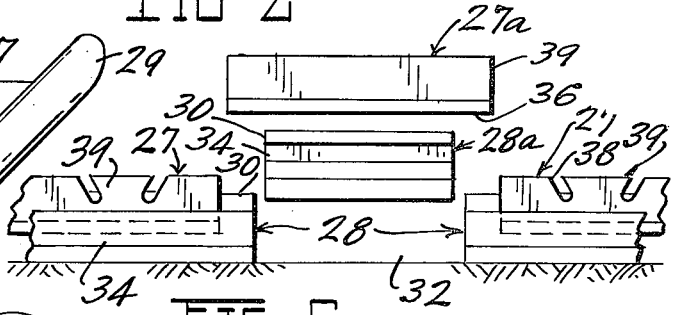
FIG. 6 shows the ends of two lengths of the connector which are joined by short sections to provide a continuous connector.
Figure 4:
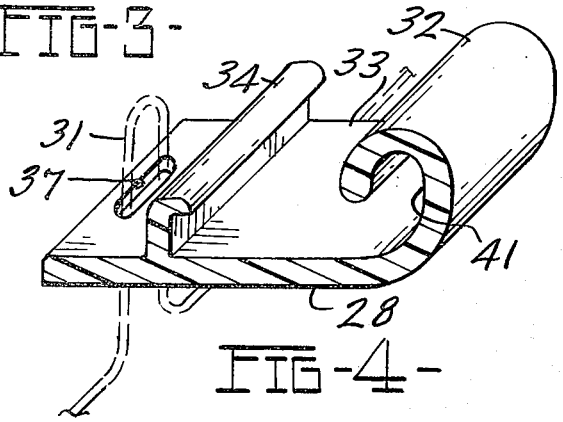
FIG. 4 is a perspective view showing the outer or base component of the film connector with the tie-down line passing therethrough.
Figure 5:
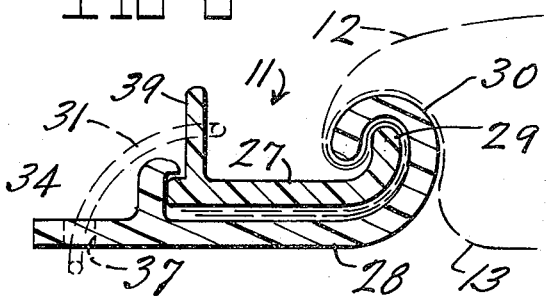
FIG. 5 is an enlarged elevational sectional view showing the assembled film connector in engagement with multiple film layers.

FIGS. 3, 4 and 5 show the individual locking and base components 27 and 28 of the plastic film connector 11 and their positions of engagement when assembled. Both components 27 and 28 preferably comprise elongate extrusions uniform in cross section throughout their length. The extrusions may be continuous throughout the length of the air heating apparatus 10, but since such structures may exceed 100 feet in length, it is preferred that the connector components be assembled from shorter lengths. The joints of the locking component may then be staggered from those of the base component, to aid in effective air sealing. Alternatively, as shown in FIG. 6, the components may be pre-assembled in nearly coextensive lengths with gaps 32 at predetermined locations to enable the structure 10 to be folded across its width. As FIG. 6 indicates, the base component 28 can extend farther into the gap 32 than the locking member 27, so that staggered joints result when closing sections 28*a* and 27*a* of the components are assembled on location.

As shown in FIG. 4, the lower or base component 28 is generally of a horizontal J shape, the rolled end 30 being positioned to receive the toe portion 29 of the locking component 27 (FIG. 3). The interior of the rolled end 30 is sized to accommodate the locking component 27 and the appropriate thickness of the film layers with narrow clearance so that the layers fit closely between the components, as shown in FIG. 5.

Extending from a flat portion 33 of the outer film connector component 28 is a latching strip 34 designed to engage and snap over a rear edge 36 of the locking component 27. Both components are formed from a material which is essentially rigid but possessing some degree of flexibility, such as rigid polyvinyl chloride, so that although the width of the inner locking component 27 is too large to permit the component to be freely inserted into the base component 28 with the film layers positioned between, both components are flexible enough to yield and allow the inner component 27 to snap into position in the base component 28 when assembled as shown at the left in FIG. 2.

As indicated in dashed lines in FIGS. 3, 4 and 5, the line 31 passes through a slotted hole 37 in the rearward end of the base film connector component 28 in looped fashion and is engaged in a pair of angled slots 38 in a vertically extending portion 39 of the locking member 27. The term "line" as used herein and in the appended claims may be considered to include any relatively flexible securing means such as hemp or plastic rope, wire, cable or chain. The line 31 is preferably continuous throughout the length of one side of the inflatable apparatus 10, and after it has been assembled to the connector 11 as shown in the figures, it is drawn taut throughout its length and staked to the ground at several locations alongside the film connector. In this way, the entire inflatable apparatus 10 is securely fastened to the ground to prevent movement and damage by wind. The manner in which the line connects to the locking member 27, via the vertically extending portion 39, helps retain the film connector 11 tightly assembled. By pulling the locking member 27 at a downwardly and rearwardly inclined angle, the line 31 helps prevent inadvertent releasing and removal of the locking member from the base member 28.

The plastic film connector 11 keeps the edges of the film layers 12 and 13 tightly retained together throughout their length so that substantially all leakage of air between the layers is prevented. This is accomplished through several design features of the film connector. The rolled end 30 of the base component 28, which is rolled through more than 180° and preferably through about 270° as seen in FIG. 5, contributes in several ways to making the film layers air tight. The fact that the layers of film must together curl around the rolled end 30 and under its tip causes the layers to be put in intimate contact in the area of the tip. The inflation of the outer encasing conduit 24 adds to this effect by putting the layers 12 and 13 into tension, forcing them more tightly together at the tip of the rolled end 30. Intimate contact between the layers is also effected at the tip of the toe portion 29 of the locking member when the layers are in tension. Another effect of the rolled end 30 is the result of the deep interior cavity 41 which is formed thereby. Besides forming a socket for engagement with the toe 29 of the locking member 27 to initiate the assembly of the two components, the deep cavity assures greater contact between the film layers when the locking member 27 is engaged in the cavity. By providing more surface area for sandwiching of the film layers between the components, greater contact and a better air-tight relationship between the layers is established.

If in the assembled apparatus 10, joints between sections of the components 27 and 28 are staggered as discussed above (e.g., as shown in FIG. 6), then air-tight contact between the layers is maintained. Since the layers tightly contact one another at both the tip of the rolled end 30 and the tip of the toe portion 29, and since one of the components is continuous where the other is interrupted, the air-tight relationship is maintained.

I claim:

1. A film connector for retaining and connecting in air-tight relationship the edges of a plurality of film layers, comprising:

an elongated base member of generally a horizontal J cross sectional shape with a central flat horizontal portion and one upwardly rolled edge defining a curve passing through more than 180°, the rolled edge having a generally cylindrical inside surface, said base member also including a generally flat rearward retaining edge opposite the rolled edge;

an elongated locking member to be received by the base member, said locking member in cross section having a central flat portion, an upwardly curved edge shaped complementarily to the generally cylindrical inside surface of the base member, and a rearward edge opposite the upwardly curved edge;

said base member further including upwardly extending yieldable lock-down means between the retaining edge and the central flat horizontal portion for receiving and retaining in snap-in fashion the rearward edge of the locking member;

said locking member being sized to lie on the base member with its upwardly curved edge engaged within the generally cylindrical inside surface of the base member and its rearward edge engaged by the yieldable lock-down means, whereby, when the plurality of film layers are placed along the upper surface of the base member from the lock-down means over the flat horizontal central portion and along the generally cylindrical inside surface of the upwardly rolled edge, said locking member may be inserted into the base member with its upwardly curved edge adjacent to the generally cylindrical inside surface and the film layers positioned therebetween, then the rearward edge of the locking member may be pushed downwardly to force the yieldable lock-down means back and to snap into engagement with the yieldable lock-down means, thereby engaging the plurality of film layers and establishing an air-tight relationship between the layers when the layers are placed in tension outside of the connector; and ground-engaging fastening means connected to the locking member and to the base member for retaining the film connector and the edges of the plurality of film layers adjacent to the ground.

2. The film connector of claim 1 wherein said ground-engaging fastening means includes upwardly extending means on said locking member between its rearward edge and its upwardly curved edge for receiving a flexible line connected to the ground.

3. The film connector of claim 1 wherein said fastening means comprises at least one flexible line connected to the ground, upwardly extending means on the locking member for receiving the flexible line, and at least one opening in the rearward retaining edge of the base member through which the flexible line passes.

4. A connector for positioning upon a supporting surface and retaining together in sealed relation at least two layers of a flexible sheet comprising, in combination, an elongate base member having, in cross sectional configuration, a flat central portion, a rolled end portion turned inwardly upon and over said central portion to provide a generally circular groove opening above said central portion and a retaining end extending above and generally normal to said central position, an elongate locking member for engagement with said base member, said locking member having in cross sectional configuration, a flat central portion between two opposed ends with one end having an upwardly curved edge of generally circular shape adapted to seat within said circular groove of said base member and the other end being spaced from said one end to rest adjacent said retaining end when said locking member is engaged with said base member, said locking member further including a hold-down means extending upwardly from said flat central portion between said opposed ends, said hold-down means including a line-securing device positioned above said flat central portion and above said retaining end of said base member when such members are assembled whereby a line secured to said securing device may extend over said retaining end thence downwardly below the flat portion of said base member for securing said connector to the adjacent support surface.

5. The connector of claim 4 which further includes a flange coplanar with said flat portion of said base member and extending outwardly beyond said retaining end, with said flange having a guide means for leading a line therethrough from above said base member to below said base member.

* * * * *